US005752756A

United States Patent [19]

Compagnucci

[11] Patent Number: 5,752,756

[45] Date of Patent: May 19, 1998

[54] MODULAR BASKET-HOLDING FRAMEWORK FOR LEFT AND RIGHT-HANDED CORNER CABINETS

[75] Inventor: Rossano Compagnucci, Osimo, Italy

[73] Assignee: Compagnucci-S.p.A., Italy

[21] Appl. No.: 828,804

[22] Filed: Mar. 27, 1997

[30] Foreign Application Priority Data

Mar. 29, 1996 [IT] Italy ..... AN960007 U

[51] Int. Cl.[6] ..... A47B 77/16

[52] U.S. Cl. ..... 312/238; 312/274

[58] Field of Search ..... 312/238, 273, 312/274

[56] References Cited

U.S. PATENT DOCUMENTS 3,195,969 7/1965 Wallen ..... 312/273 X 4,832,300 5/1989 Twellmann ..... 312/322 X

FOREIGN PATENT DOCUMENTS 2232670 1/1974 Germany ..... 312/238

2350343 5/1974 Germany ..... 312/238

404325108 11/1992 Japan ..... 312/238

*Primary Examiner*—Peter M. Cuomo

*Assistant Examiner*—David E. Allred

*Attorney, Agent, or Firm*—Leonard Bloom

[57] ABSTRACT

This invention relates to a modular basket-holding framework for corner cabinets, composed of a number of modular elements designed so that they may be assembled in two different, specular ways, in order to achieve—using the same elements—a framework that can be mounted in corner cabinets with both left and right-hand opening.

1 Claim, 9 Drawing Sheets

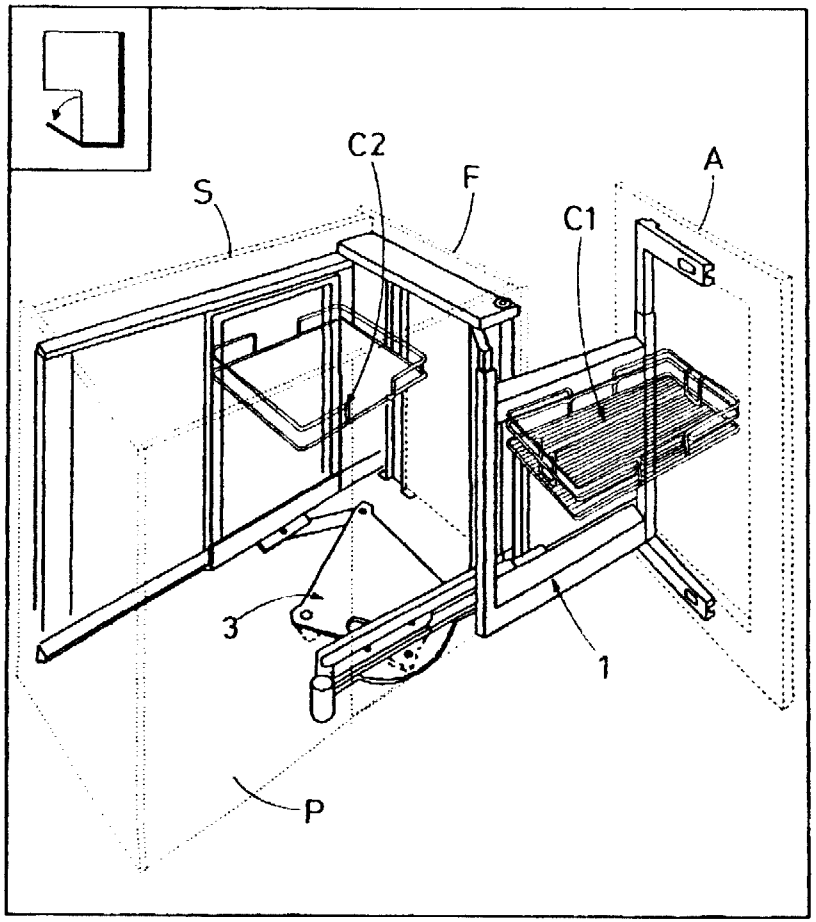
FIG. IB
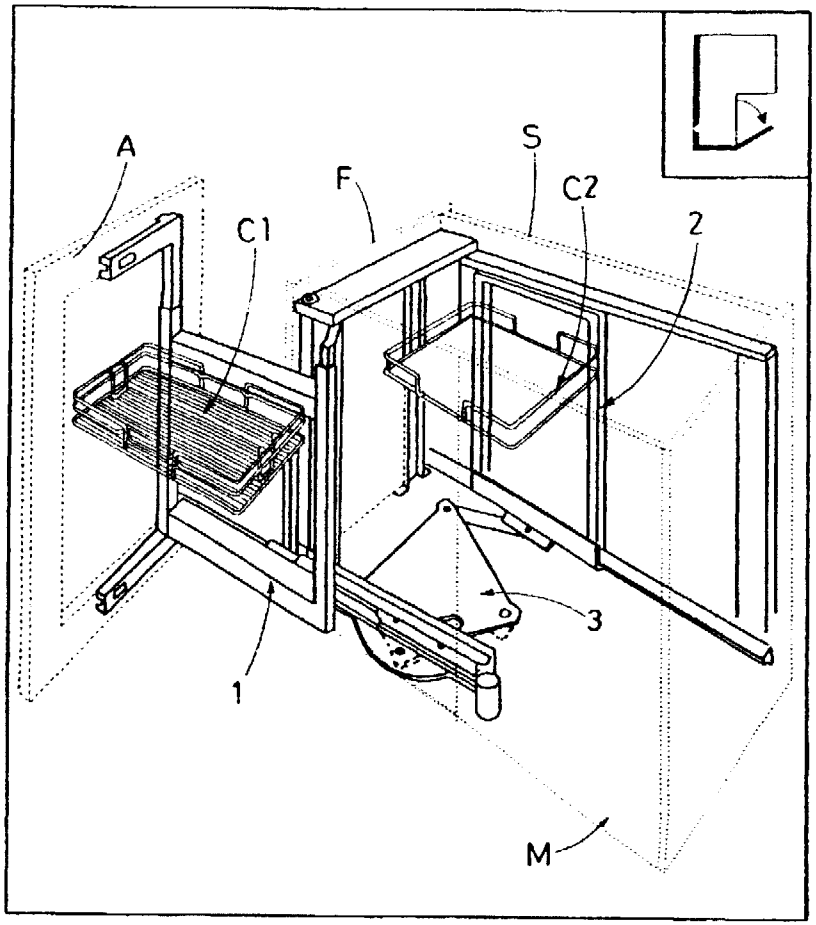
FIG. IA

MODULAR BASKET-HOLDING FRAMEWORK FOR LEFT AND RIGHT-HANDED CORNER CABINETS

This patent application concerns a modular basket-holding framework for left and right-handed corner cabinets, that is, cabinets with doors opening on the left or right-hand.

It is commonly known that modular kitchens stretching along two consecutive walls are provided with connecting corner cabinets, which are internally fitted with articulated basket-holding frameworks in order to best exploit their inner capacity.

One such framework consists of a supporting upright on which are hinged two superposed half-moon glide-out baskets, half of which lodged in the corner space itself and half in the space behind the door opening.

When the door is open, the baskets may be pivoted 90° around the supporting upright, so that one half of the baskets is extracted while the other half—normally confined in the corner space—is moved to the more accessible position previously occupied by the portion of the basket that has been extracted.

It is evident that this kind of system can be indiscriminately mounted, without any modification or adaptation, in corner cabinets with doors opening both clockwise and counterclockwise.

Such is not the case for another appliance, rather more complex than the previous one which actually necessitates two different versions, one to fit corner cabinets with a right-hand door, and the other to fit corner cabinets with a left-hand door. The above appliance consists of two basket bearing pull-out trolleys, each made of an upright supporting framework and a series of superposed overhanging baskets mounted on the aforementioned framework: each trolley glides on its respective horizontal guide runners.

One of the trolleys is fixed to the inside of the door and slides on its respective supporting and guide runners which are attached internally to one side of the corner cabinet, whereas the other trolley slides along its own individual supporting and guide runners that are attached to the back of the corner cabinet.

Corner cabinets suited to the fitting of this kind of appliance feature an unhinged door which is simply attached, as mentioned above, to one of the two trolleys.

Functionally speaking, as the door is opened the first trolley, the one attached to the door itself, is extracted, drawer like; once extracted, such trolley can be swung outwards along with the attached door, so that the opening is freed and the inside of the cabinet can be reached; owing to a specially designed crank mechanism connecting the two trolleys, the rotation of the first trolley causes the second trolley to be translated—in orthogonal direction with the extraction of the first trolley—from inside the corner to the same position previously occupied by the first trolley.

In other words, when the door is shut the two pull-outs are side by side, as the first is located in the space behind the door and the second in the corner space; when the door is opened and swung to one side, the second pull-out takes the place of the first one, which, in turn, is then outside the cabinet, to the right or left of the opening section, according to which side the cabinet door opens.

It is the object of the present invention to provide a modular appliance for corner cabinets of the kind hereby described, composed of a number of modular elements which installers can use to assemble the same appliance in cabinets with both left or right-hand doors, making it unnecessary to order the left or right version of the appliance accordingly, as installers still have to do today.

For major clarity the description of the invention continues with reference to the enclosed drawings which are intended for purposes of illustration and not in a limiting sense, whereby:

FIG. 1A shows schematically, in perspective, the framework question fitted in a corner cabinet with a left-hand opening door and with the first trolley extracted and swung round;

FIG. 1B shows schematically, in perspective, the framework in question fitted in a corner cabinet with a right-hand opening door and with the first trolley extracted and swung round;

the double specular figures starting from (3A and 3B) up to (9A and 9B) show the steps to follow in assembling the various components of the framework according to whether such framework is to be mounted in a left-hand opening corner cabinet (in those figures marked A) or a right-hand opening corner cabinet (in those figures marked B). Referring to FIGS. 1A and 1B, the framework in question is of an already common type, made up of a first trolley (C1) which is able to revolve and slide with one or more superposed overhanging baskets mounted on a supporting metallic frame (1) resting on a vertical plane and sliding along horizontal guide runners fitted to the side (F) of the corner cabinet (M), and a second trolley (C2) consistent with the first, with its supporting frame (2) resting on a vertical plane and only able to slide along the horizontal guide runners fixed to the back (S) of the corner cabinet (M).

The frame (1), when the first trolley (C1) is fully extracted, may be pivoted around a supporting upright, in such a way as to free the opening and make the inside of the cabinet accessible. The cabinet door (A) of the cabinet (M) is attached to the frame (1) of the first trolley (C1), so that by pulling the door (A) it is possible to slide out the first trolley (C1), to which the second trolley (C2) is connected by means of a crank mechanism (3) designed to slide out the second trolley once the first trolley has been completely extracted and swung to one side.

Figure 2:
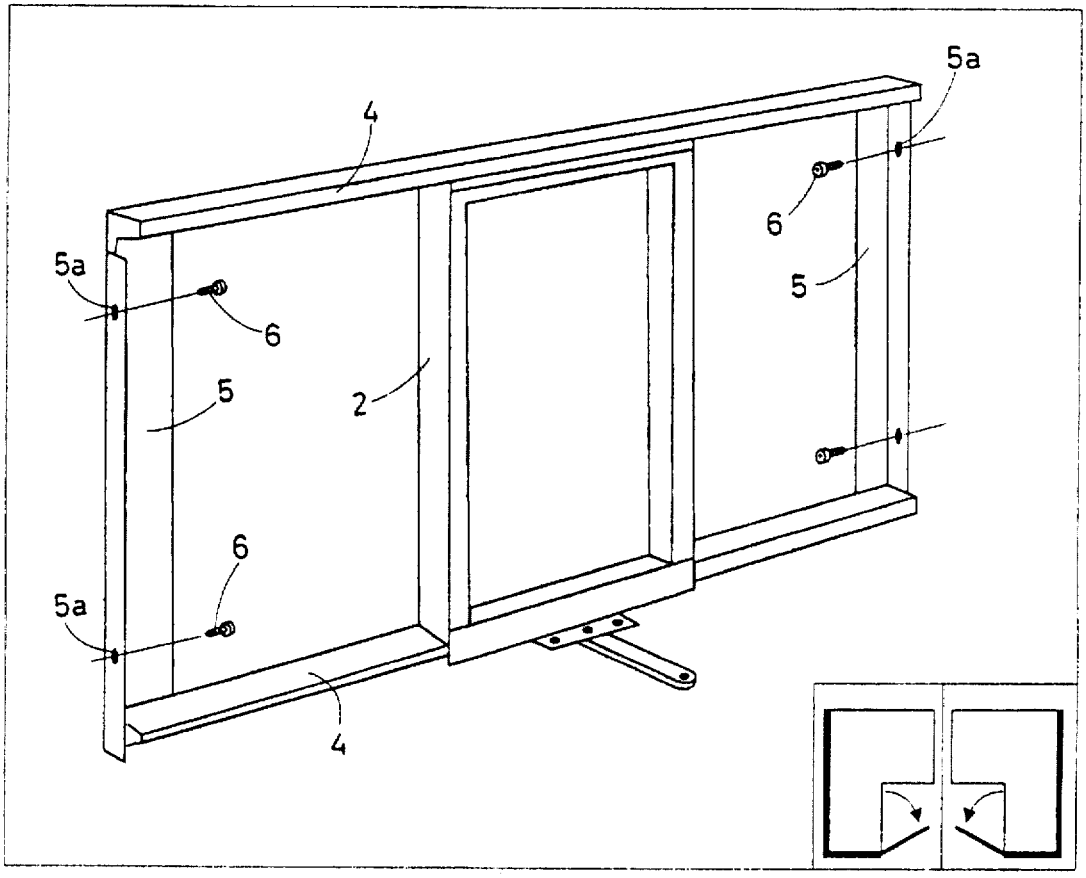
FIG. 2 shows, in an axonometric drawing, the trolley fitted and running on the back panel of the corner cabinet.

Referring to FIG. 2, the supporting frame (2) of the second trolley is made up of four metallic sections welded at right angles and runs along a pair of superposed horizontal runners (4), integrated by two end uprights (5), provided with holes (**5*a*) to allow for the fitting of an equal number of fixing screws (6). The counter-frame formed by the runners (4) and the uprights (5) is leant against the back (S) of the cabinet and is firmly fixed in this position using screws (6). In accordance with the present invention, the framework is characterized in that it is made up of a series of modular components for the construction of the first trolley, its relative supporting counter-frame and the aforementioned crank mechanism (3); this series of modular components are designed so that they may be assembled in two different, specular ways, in order to achieve, using the same elements, a trolley (C1) and a crank mechanism (3**) which may be rotated to the right or, vice versa, to the left.

Figures 3A, 3B:
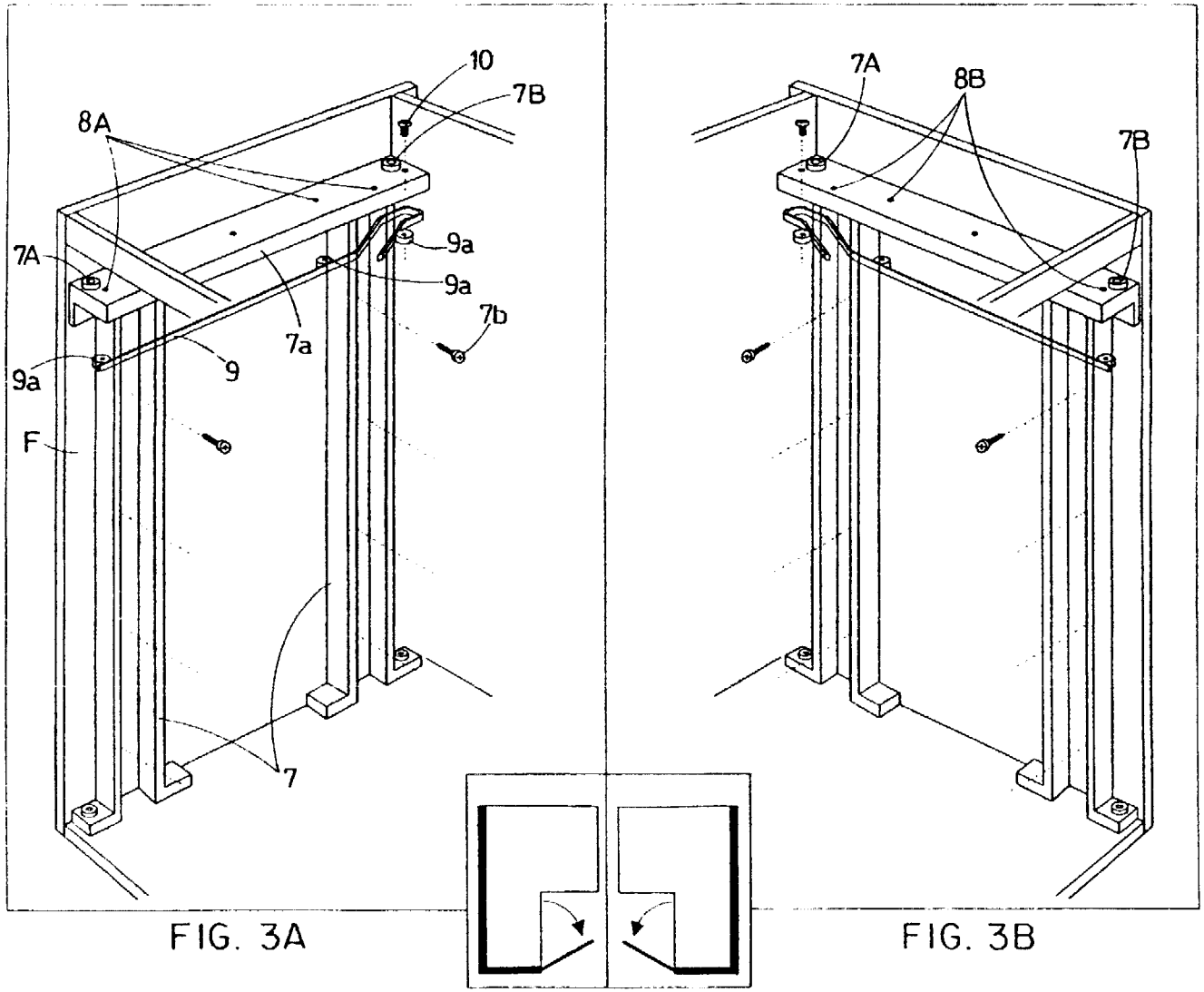
Figure 4B:
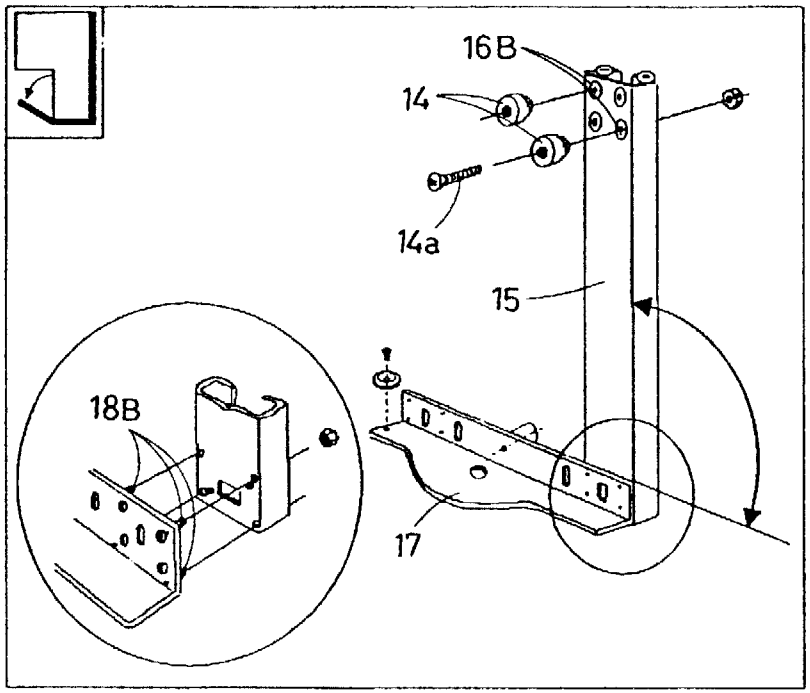
Figure 4A:
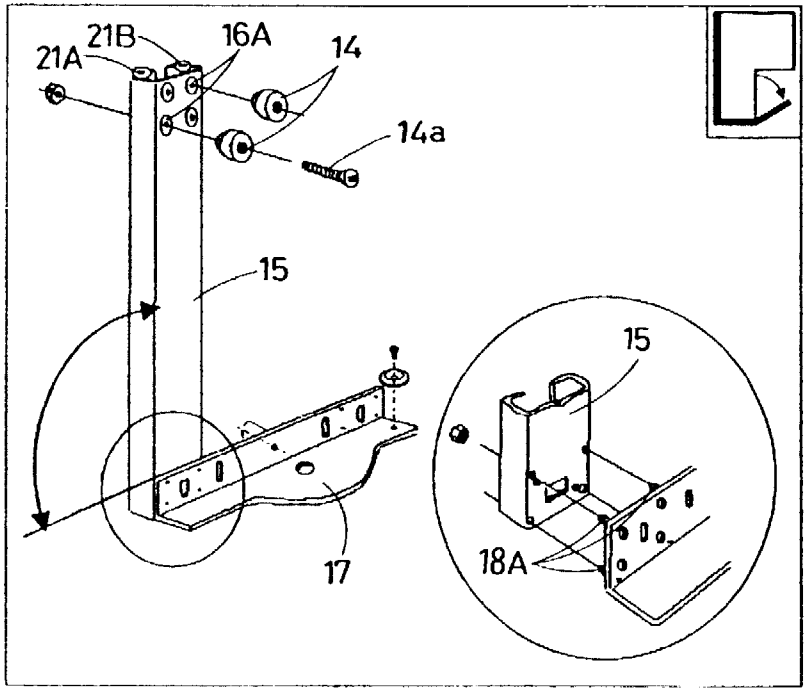
Figures 5A, 5B:
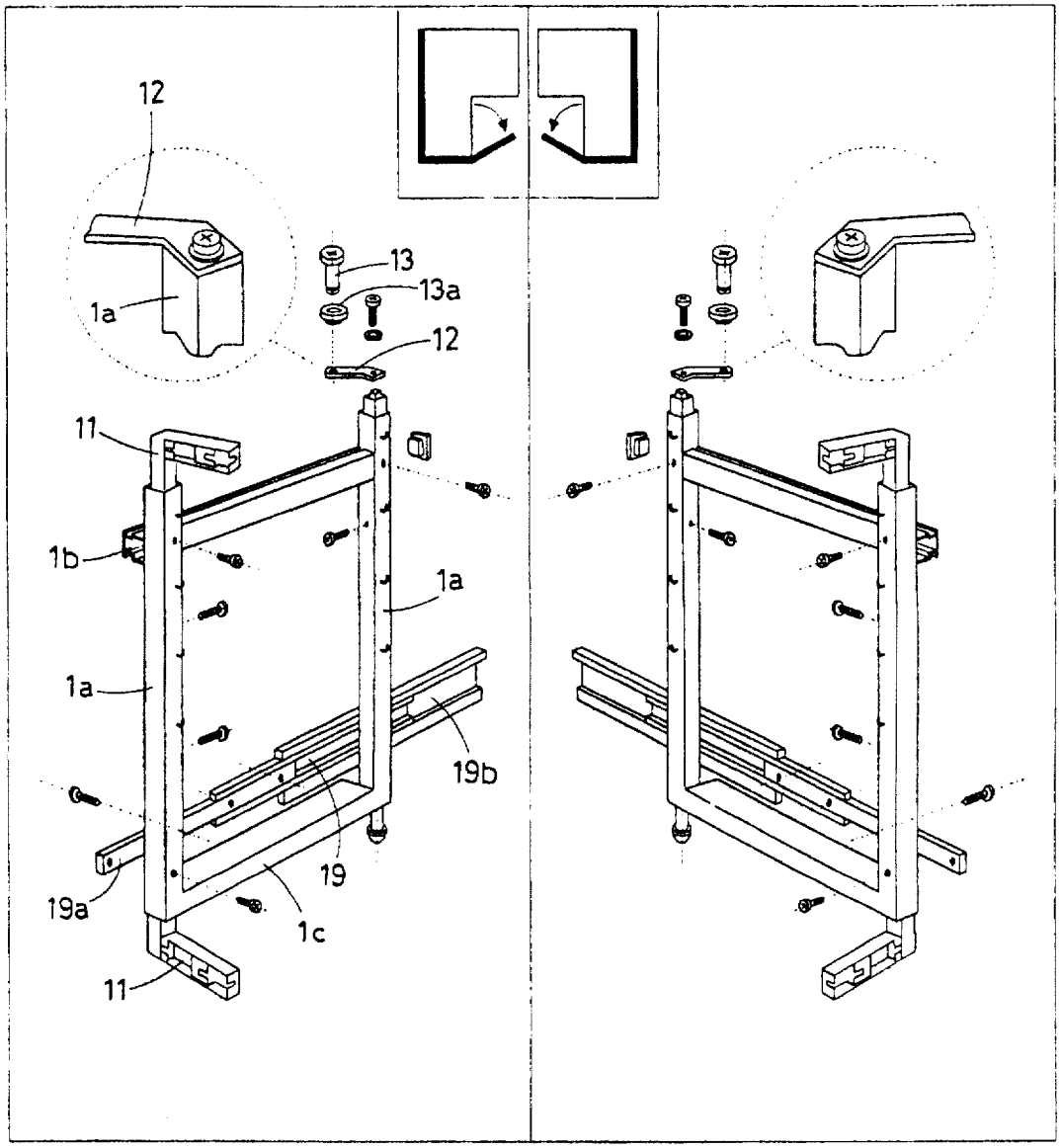
Figures 6A, 6B:
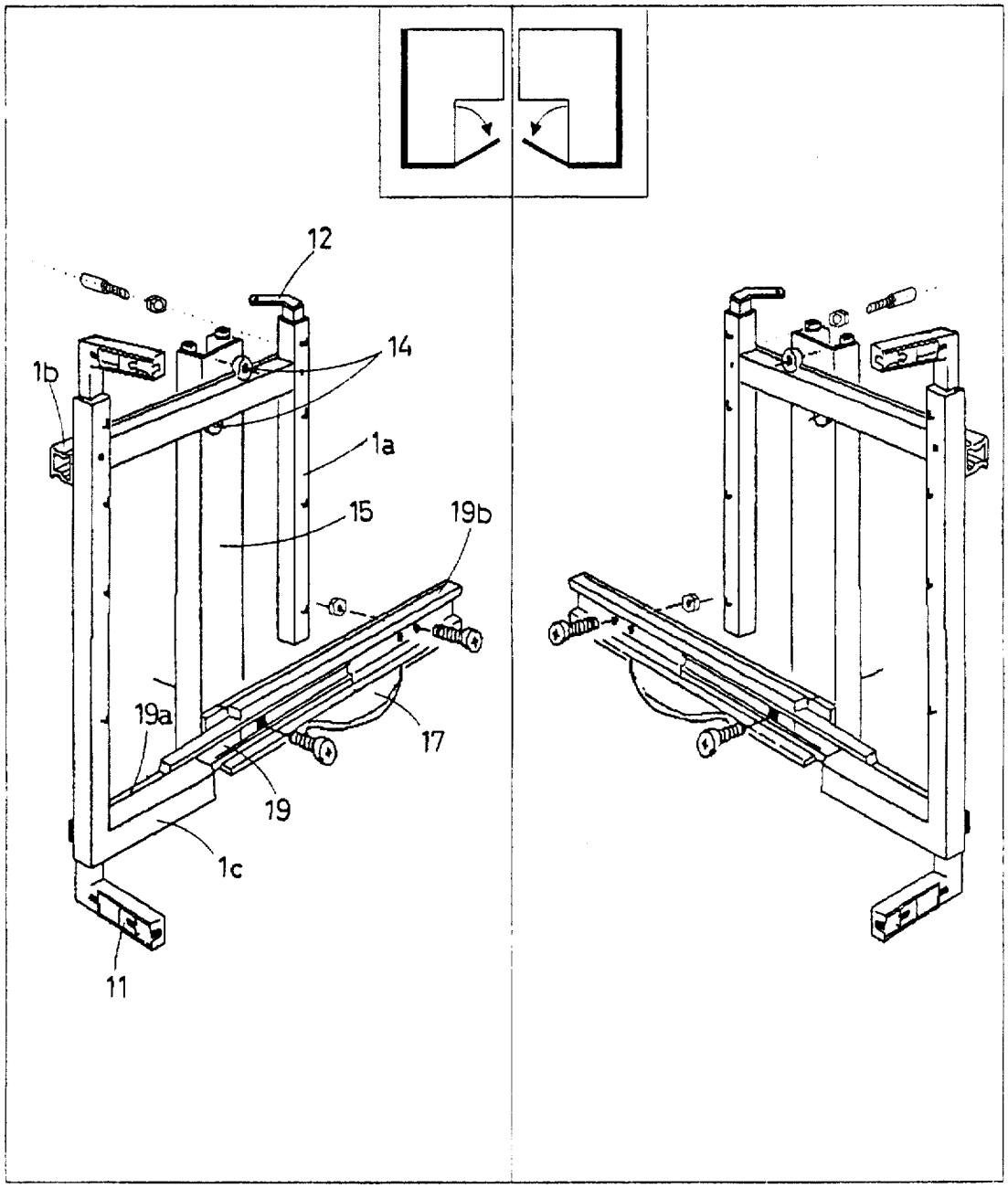

Referring to FIGS. 3A and 3B, the upper guide runner (**7*a*) of the supporting frame (1) of the first trolley (C1) is an integral part of a doorway supporting structure (7) to be leant against and fixed with screws (7*b***) to the inner left or right side (F) of the cabinet (M).

Along this runner there are two triplets of holes (8A and 8B) to be used accordingly (in case of a left or right-handed opening) to mount a cam-rod (9) which guides the outward movement of the first trolley. Along the cam-rod (9) three screw eyes are machined (**9*a*) into which the screws (10) are inserted through one or the other of the triplets of holes (8A and 8B**).

In its turn, the cam-rod (9) need simply be rotated to one side or the other depending upon the opening direction of the first trolley.

Referring to the FIGS. (4A and 4B) and to the FIGS. (5A and 5B) the frame (1) is made up of four tubular sections welded at right angles; on to the lateral uprights (1*a*) of these are attached, on one side, a pair of right-angled sections (11) and, on the other side, a small top bracket (12), bearing the pivot pin (13) of an idle wheel (13*a*), which is lodged and runs inside a guiding channel bounded by the cam-rod (9) on one side, and by the aforementioned top guide runner (7*a*) on the other.

The upper cross member of the supporting frame (1) has a protruding runner (1*b*) fixed to its back side which is interposed and runs between a pair of superposed staggered bearings (14), fixed with screws (14*a*) to the top of an upright (15); such upright actually presents two crossed pairs of holes (16A and 16B) to be used accordingly (in case of a left or right-handed opening) for the fixing of the screws (14*a*).

At the base of such upright (15) a cantilevered bracket (17) must be mounted which has at both ends a series of four welded screws (18A and 18B) to be used accordingly (in case of a left or right-handed opening) to fasten it to the upright (15). To the lower cross member (1*c*) of the frame (1) the inner rod (19*a*) of a telescopic runner (19) is screwed, the outer rod (19*b*) of which is screwed to the aforementioned bracket (17), as shown in FIGS. (6A and 6B).

On the upper section of the upright (15) a pair of threaded holes (21A and 21B) are provided to screw on, as necessary (in the case of a left or right-handed opening), the pivot pin (21) of the upright (15), which is itself fixed, as necessary, to either of the two end holes (7A or 7B) provided for this purpose along the aforementioned runner (7).

Figure 7B:
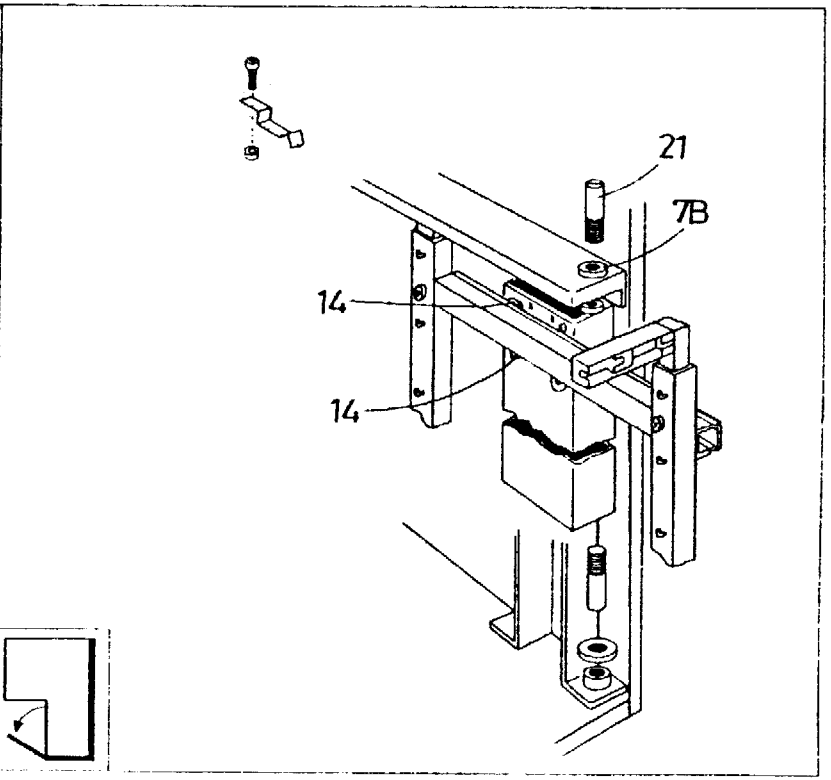
Figure 7A:
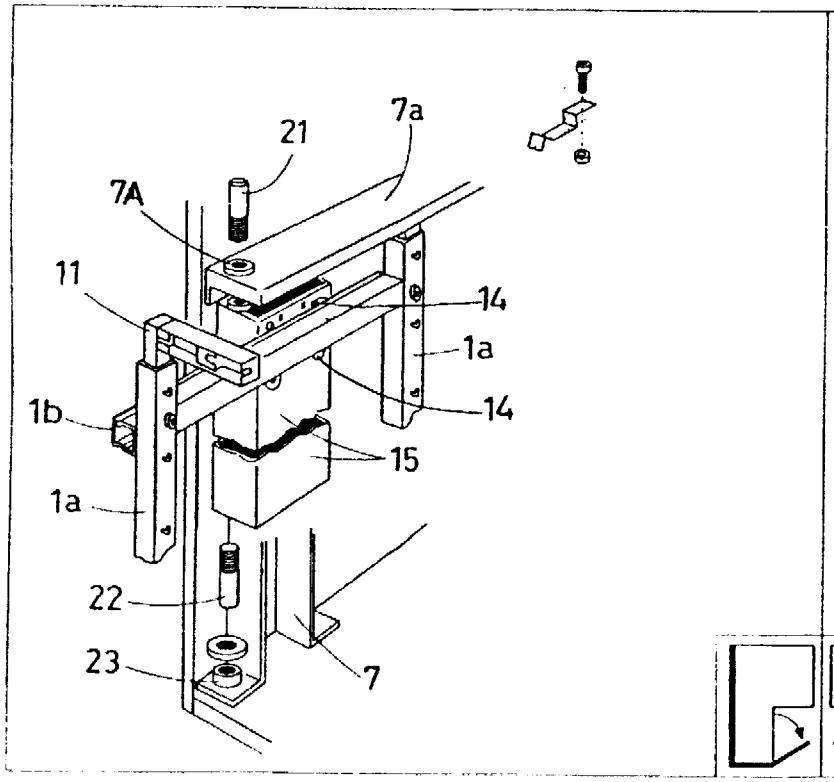

At the base of the upright (15) there is also a pair of threaded holes (not visible in the figures) provided for fixing, as necessary (in the case of a left or right-handed opening), the upright's (15) lower pivot pin (22), which is seated in a bush (23) attached to the base of one or other of the lower cross members of the supporting structure (7), as shown in FIGS. 7A and 7B.

Figures 8A, 8B:
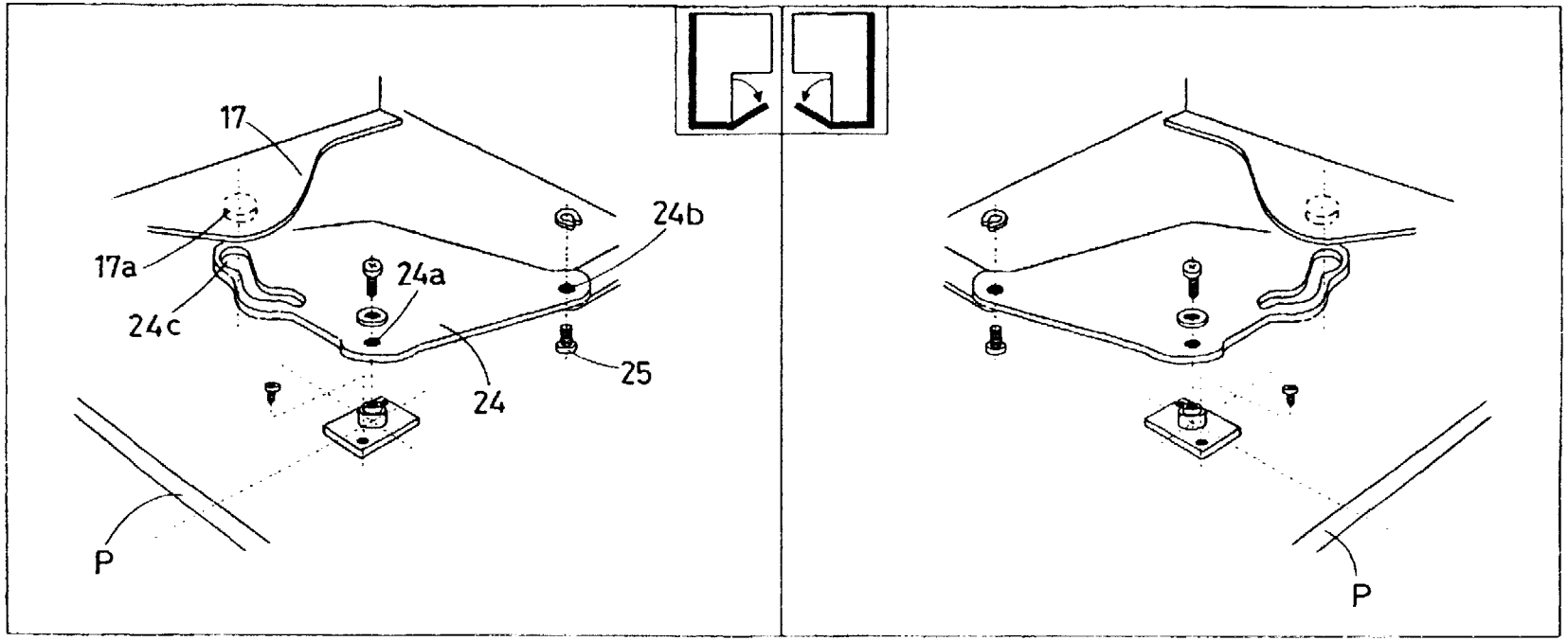

Referring to FIGS. 8A and 8B the crank mechanism (3) consists of a circular segment shaped plate (24), with a central hole (24*a*) for a pivot pin to be fixed to the bottom surface (P) of the cabinet, a lateral hole (24*b*) and a slot cut-out (24*c*) located opposite to the hole (24*b*).

To the hole (24*b*) a pivot (25) is attached which connects the plate (24) to the supporting frame (2) of the second trolley (C2), while the slot (24*c*) serves for the connection of the plate (24) to the bracket (17), on to which a wheel (17*a*), designed to sit snugly and run in the slot (24*c*), is fitted.

Figures 9A, 9B:
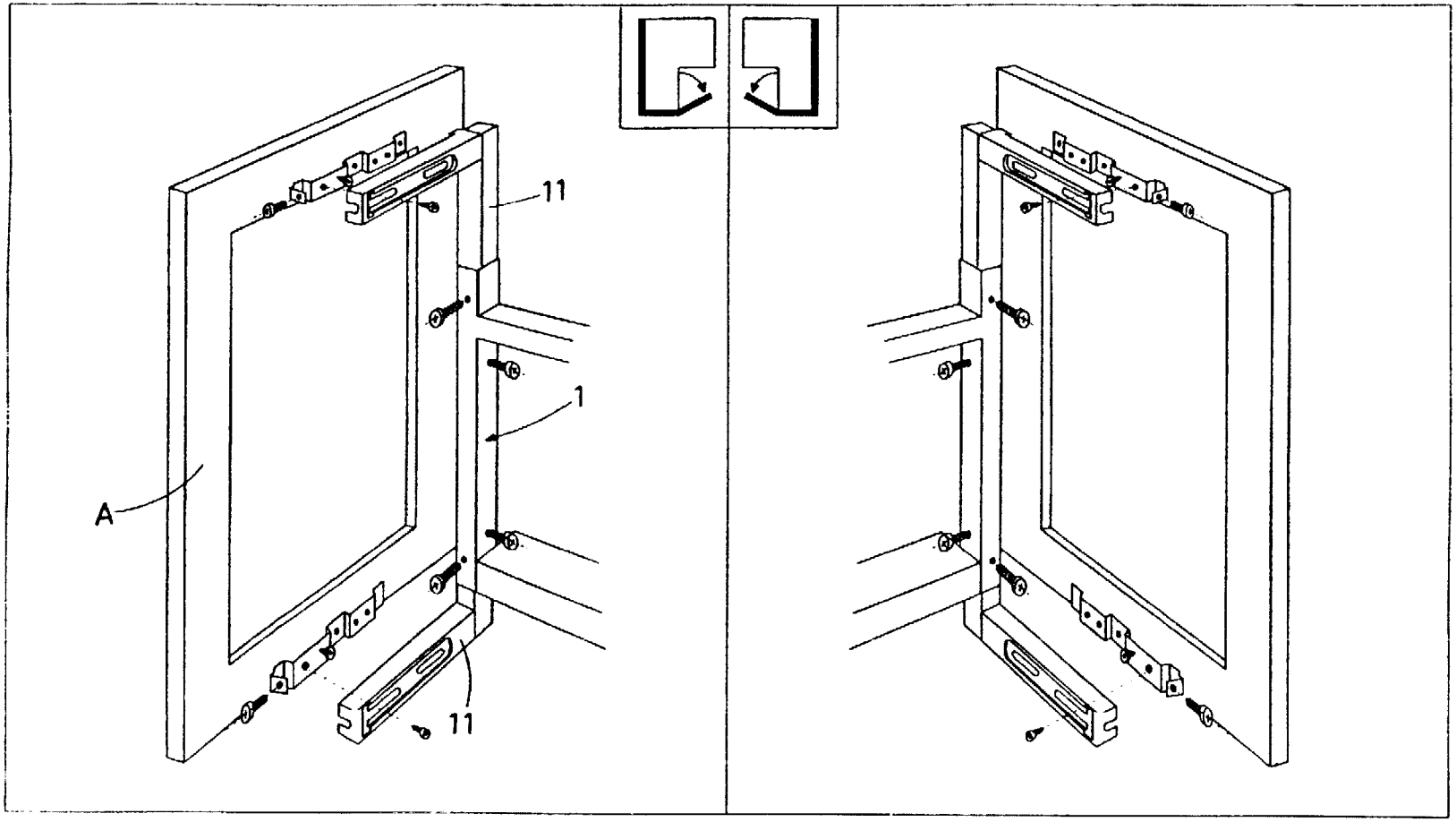

The plate (24) need simply be rotated to one side or the other depending upon the opening direction of the first trolley. FIGS. 9A and 9B show how the door (A) of the cabinet is screwed to the pair of right-angled sections (11), previously attached to the ends of one of the lateral uprights (1*a*) of the frame (1).

It is to be stressed, in conclusion, the double function of the pair of superposed staggered bearings (14), which serve both as a guide for the movement of the runner (1*b*) and, at the same time, ensure the stability of the frame (1), such action being all the more important when the first trolley (C1) is completely extracted from the cabinet.

For such reason the frame (1), if of considerable height (for example in a corner closet), is provided with extra cross members fitted with protruding runners (1*b*) each running between a related pair of superposed staggered bearings (14); the upright (15), in such case, is provided with a greater number of crossed pairs of holes (16A and 16B) as necessary, given the number of runners (1*b*) on the supporting frame (1).

I claim:

1. A modular basket-holding framework for left and right-handed corner cabinets with doors opening on the left or right-hand, of a kind comprising:

a first trolley (C1) which is able to revolve and slide with one or more superposed overhanging baskets mounted on a supporting metallic frame (1) resting on a vertical plane and sliding along horizontal guide runners fitted to the side (F) of the corner cabinet (M);

a second trolley (C2) consistent with the first, with its supporting frame (2) resting on a vertical plane and only able to slide along the horizontal guide runners (4) fixed to the back (S) of the corner cabinet (M).

a crank mechanism (3) connecting the first and second trolley, such mechanism being designed to slide out the second trolley once the first trolley has been completely extracted and swung to one side;

a framework characterized in that it comprises:

an upper guide runner (7*a*) for the supporting frame (1), being an integral part of a doorway supporting structure (7) provided with two triplets of holes (8A and 8B) for the mounting of a cam-rod (9), which presents three screw eyes (9*a*) into which the screws (10) are inserted through one or the other of the triplets of holes (8A and 8B), a frame (1) made up of four tubular sections welded at right angles, with one or more cross members provided with a back runner (1*b*), interposed and running between a pair of superposed staggered bearings (14), an oscillating upright (15) which presents a number of crossed pairs of holes (16A and 16B) as necessary, given the number of runners (1*b*) on the supporting frame (1), each pair of holes (16A and 16B) being used for the fastening of the fixing screws (14*a*) of the aforementioned pairs of bearings (14); such upright (15) having, in its upper section, a pair of threaded holes (21A and 21B) for the fastening, as necessary, of the pivot pin (21) of the upright (15), which is itself fixed, as necessary, to either of the two end holes (7A or 7B) provided for this purpose along the aforementioned runner (7); having, furthermore, at its base a pair of threaded holes provided for fastening as necessary the upright's (15) lower pivot pin (22), which is seated in a bush (23) attached to the base of one or other of the lower cross members of the aforementioned supporting structure (7), a pair of right-angled sections (11) to be fixed to the two ends of one of the uprights (1*a*) of the frame (1), a small top bracket (12), bearing the pivot pin (13) of an idle wheel (13*a*), which is lodged and runs inside a guiding channel bounded by the cam-rod (9) on one side, and by the aforementioned top guide runner (7*a*) on the other, a bracket (17), having at both ends a series of four welded screws (18A and 18B) to be used accordingly to fasten it to the base of the upright (15), a telescopic runner (19), the inner rod of which (19*a*) is attached to the cross member (1*c*) of the frame (1), while the outer rod (19*b*) is screwed to the aforementioned bracket (17), a crank mechanism (3) consisting of a circular segment shaped plate (24), with a central hole (24*a*) for a pivot pin, a lateral hole (24*b*) and a slot cut-out (24*c*) located opposite to the hole (24*b*); it being provided that the pivot (25) is seated in the hole (24*b*) connecting the plate (24) to the supporting frame (2) of the second trolley (C2), while in the slot (24*c*) a wheel (17*a*), fixed to the aforementioned bracket (17), is seated.

* * * * *

UNITED STATES PATENT AND TRADEMARK OFFICE

CERTIFICATE OF CORRECTION

PATENT NO. : 5,752,756
DATED : May 19, 1998
INVENTOR(S) : Rossano Compagnucci

It is certified that error appears in the above-identified patent and that said Letters Patent is hereby corrected as shown below:

In the Abstract

On line 4, change "specular" to read --mirror image--.

IN COLUMN 1, LINE 4, PLEASE , insert --BACKGROUND OF THE INVENTION--.

In column 1, between lines 60 and 61, insert --SUMMARY OF THE INVENTION--.

In column 2, between lines 4 and 5, insert --BRIEF DESCRIPTION OF THE DRAWINGS--.

In column 2, line 14, delete completely and substitute therefor --FIGS. 3A through 9B--.

In column 2, line 15, delete "to (9A and 9B)".

In column 2, lines 19-20, begin a new paragraph with --Referring to--.

In column 2, after line 19 and before the new paragraph, insert --DESCRIPTION OF THE PREFERRED EMBODIMENTS--.

In column 2, lines 45 and 58, change "leant" to read --abutted--.

In column 2, line 53, change "specular" to read --mirror image--.

UNITED STATES PATENT AND TRADEMARK OFFICE

CERTIFICATE OF CORRECTION

PATENT NO. : 5,752,756
DATED : May 19, 1998
INVENTOR(S) : Rossano Compagnucci

It is certified that error appears in the above-identified patent and that said Letters Patent is hereby corrected as shown below:

In the Claims

Cancel claim 1 and substitute therefor:

1. A modular basket-holding framework for left and right-handed corner cabinets with doors opening on the left or right-hand, comprising:

a first trolley (C1) with one or more superposed overhanging baskets mounted on a supporting metallic frame (1) rotatably mounted parallel to a first vertical plane and slidably supported on horizontal guide runners fitted to the side (F) of the corner cabinet (M);

a second trolley (C2) slidably mounted with its supporting frame (2) slidably mounted parallel to a second vertical plane and only able to slide on horizontal guide runners (4) fixed to the back (S) of the corner cabinet (M);

a crank mechanism (3) consisting of a circular segment shaped plate (24), with a central hole (24a) receiving a pivot pin attached to a bottom surface (P) of the cabinet, said It is certified that error appears in the above-identified patent and that said Letters Patent is hereby corrected as shown below:

circular segment further consisting of a lateral hole (24b) and a slot cut-out (24c) located on a side of said central hole (24a) opposite to the hole (24b); wherein a pivot (25) is seated in the hole (24b) connecting the plate (24) to the supporting frame (2) of the second trolley (C2) while a wheel (17a) is seated in the slot (24c) and fixed to a large bracket (17) fixed to said first trolley (C1), said crank mechanism (3) connecting the first and second trolley, such that said mechanism slides out the second trolley once the first trolley has been completely extracted from one of said cabinets and swung to one side;

a framework characterized in that it comprises:

an upper guide runner (7a) for the supporting frame (1), being an integral part of a doorway supporting structure (7) provided with two triplets of holes (8A and 8B) for the mounting of a cam-rod (9), wherein said upper guide runner presents three screw eyes (9a) into which screws (10) are inserted through one or the other of the triplets of holes (8A and 8B),

UNITED STATES PATENT AND TRADEMARK OFFICE

CERTIFICATE OF CORRECTION

PATENT NO. : 5,752,756
DATED : May 19, 1998
INVENTOR(S) : Rossano Compagnucci

It is certified that error appears in the above-identified patent and that said Letters Patent is hereby corrected as shown below:

a frame (1) made up of four tubular sections welded at right angles, and comprising one or more cross members provided with a back runner (1b), interposed and running between a pair of superposed staggered bearings (14) supported on an oscillating upright (15), said oscillating upright (15) which presents a number of crossed pairs of holes (16A and 16B) , each pair of holes (16A and 16B) fastening fixing screws (14a) which secure said pairs of bearings (14) to said oscillating upright; said oscillating upright (15) having in its upper end, a pair of threaded holes (21A and 21B) fastening a pivot pin (21) which is fixed to either of the two end holes (7A or 7B) provided for this purpose along the aforementioned runner (7A); said oscillating upright further being similarly pivotably connected at its base to a lower pivot pin (22), which is seated in a bush (23) attached to a base of the aforementioned supporting structure (7), in alignment with one of said threaded holes (21A and B);

said four tubular sections of said frame (1) further comprising uprights (1a), a pair of right-angled sections (11) fixed to two ends of one of the uprights (1a) of the frame (1),

UNITED STATES PATENT AND TRADEMARK OFFICE

CERTIFICATE OF CORRECTION

PATENT NO. : 5,752,756
DATED : May 19, 1998
INVENTOR(S) : Rossano Compagnucci

It is certified that error appears in the above-identified patent and that said Letters Patent is hereby corrected as shown below:

a small top bracket (12), bearing a pivot pin (13) of an idle wheel (13a), which is lodged and runs inside a guiding channel bounded by the cam-rod (9) on a side, and by the aforementioned top guide runner (7a) on a top of said idle wheel, said large bracket (17), having at both ends a series of four welded screws (18A and 18B) fastening it to said base of the upright (15), a telescopic runner (19), an inner rod of which is attached to a cross member (1c) of the frame (1), while the outer rod (19b) is screwed to the aforementioned bracket (17).

Signed and Sealed this
Eighteenth Day of May, 1999

*Attest:*

*Attesting Officer*

Q. TODD DICKINSON

*Acting Commissioner of Patents and Trademarks*